US007585053B2

(12) United States Patent
Kim et al.

(10) Patent No.: US 7,585,053 B2
(45) Date of Patent: Sep. 8, 2009

(54) THERMAL INKJET PRINTHEAD

(75) Inventors: Nam-kyun Kim, Seongnam-si (KR); Jae-sik Min, Suwon-si (KR); Eun-bong Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 482 days.

(21) Appl. No.: 11/501,683

(22) Filed: Aug. 10, 2006

(65) Prior Publication Data

US 2007/0076056 A1 Apr. 5, 2007

(30) Foreign Application Priority Data

Oct. 4, 2005 (KR) ..... 10-2005-0093055

(51) Int. Cl.
*B41J 2/05* (2006.01)

(52) U.S. Cl. ..... 347/56; 347/63

(58) Field of Classification Search ..... 347/17, 347/18, 20, 56, 61–65, 67
See application file for complete search history.

(56) References Cited

U.S. PATENT DOCUMENTS 5,367,324 A * 11/1994 Abe et al. ..... 347/43
5,861,902 A * 1/1999 Beerling ..... 347/63
2004/0155930 A1 8/2004 Cho et al.

FOREIGN PATENT DOCUMENTS

| | | |
|---|---|---|
| JP | 08-174827 | 7/1996 |
| JP | 10-76649 | 3/1998 |
| JP | 2001-191529 | 7/2001 |
| JP | 2002-172781 | 6/2002 |

OTHER PUBLICATIONS

Korean Office Action dated Oct. 27, 2006 issued in KR 2005-93055.

* cited by examiner

*Primary Examiner*—Juanita D Stephens
(74) *Attorney, Agent, or Firm*—Stanzione & Kim LLP

(57) ABSTRACT

A thermal inkjet printhead includes a substrate, an insulation layer formed on the substrate, a heater formed on the insulation layer, a conductor formed on the heater to supply a current to the heater, a chamber layer stacked on the insulation layer having the heater and the conductor therebetween, and having an ink chamber to be filled with ink to be ejected formed therein; a nozzle layer stacked on the chamber layer and having a nozzle through which the ink in the ink chamber is to be ejected, and a plurality of thermal plugs formed in a lower portion of the insulation layer to contact the insulation layer and the substrate and to dissipate heat generated by the heater toward the substrate.

24 Claims, 3 Drawing Sheets

THERMAL INKJET PRINTHEAD

CROSS-REFERENCE TO RELATED APPLICATIONS

This application claims priority under 35 U.S.C. §119(a) from Korean Patent Application No. 10-2005-0093055, filed on Oct. 4, 2005, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a thermal inkjet printhead to enhance ink ejection characteristics thereof by preventing and/or dissipating heat accumulation around a heater thereof.

2. Description of the Related Art

An inkjet printhead ejects ink droplets on desired positions of recording paper in order to print predetermined color images. Inkjet printers are classified into two categories: a shuttle type inkjet printer having a printhead that is shuttled in a direction perpendicular to a transporting direction of a print medium, and a line printing type inkjet printer having a page-wide array printhead corresponding to a width of a print medium. The latter has been developed for realizing high-speed printing. The array printhead has a plurality of inkjet printheads arranged in a predetermined configuration. In the line printing type inkjet printer, during printing, the array printhead is fixed and a print medium is transported, thereby allowing the high-speed printing.

The inkjet printhead is categorized into two types according to the ink droplet ejection mechanism thereof: a thermal inkjet printhead and a piezoelectric inkjet printhead. The thermal inkjet printhead ejects ink droplets due to an expansion force of ink bubbles generated by thermal energy. The piezoelectric inkjet printhead ejects ink droplets by a pressure applied to ink due to a deformation of a piezoelectric body.

The ink droplet ejection mechanism of the thermal inkjet printhead is as follows. When a current flows through a heater made of a heating resistor, the heater is heated and ink near the heater in an ink chamber is instantaneously heated up to about 300° C. Accordingly, ink bubbles are generated by ink evaporation and the generated bubbles are expanded to exert a pressure on the ink filled in the ink chamber. Thereafter, an ink droplet is ejected through a nozzle out of the ink chamber.

FIG. 1 is a schematic cross-sectional view illustrating a conventional thermal inkjet printhead. Referring to FIG. 1, the conventional inkjet printhead includes a substrate 11 on which a plurality of material layers are stacked, a chamber layer 20 stacked on the substrate 11 and defining an ink chamber 22, and a nozzle layer 30 stacked on the chamber layer 20. Ink is filled in the ink chamber 22 and a heater 13 to heat the ink to generate bubbles therein is installed under the ink chamber 22. In addition, the nozzle layer 30 has a nozzle 32 to eject the ink.

The substrate 11 is generally a silicon substrate. An insulation layer 12 to provide insulation between the heater 13 and the substrate 11 is formed on the substrate 11. The insulation layer 12 is generally made of silicon oxide. The heater 13 to heat the ink in the ink chamber 22 to generate bubbles therein is disposed on the insulation layer 12. Conductors 14 to supply an electric current to the heater 13 are disposed on the heater 13.

A passivation layer 15 is formed on the heater 13 and the conductors 14 to protect the heater 13 and the conductors 14.

The passivation layer 15 prevents the heater 13 and the conductors 14 from oxidizing or directly contacting the ink, and is generally formed of silicon oxide or silicon nitride. An anti-cavitation layer 16 is formed on the passivation layer 15. The anti-cavitation layer 16 protects the heater 13 from a cavitation pressure induced by bubble extinction, and is generally made of tantalum (Ta).

In this structure, some heat generated by the heater 13 is used to form bubbles and the rest of the heat (i.e., residual heat) should be dissipated through the insulation layer 12 formed under the heater 13 toward the substrate 11. However, because the insulation layer 12 is made of silicon oxide having low thermal conductivity, the residual heat generated by the heater 13 may not be dissipated toward the substrate 11, but instead may be accumulated in the insulation layer 12 near the heater 13. When the heat is accumulated in the insulation layer 12, the temperature of the ink filled in the ink chamber 22 increases, and thus a viscosity of the ink decreases, thereby degrading ink ejection characteristics, such as ink ejection frequency and ink ejection velocity.

Recently, line printing type inkjet printers have been actively developed to satisfy demands of high integration and high speed. Since an array printhead used in the line printing type inkjet printer includes many heaters, a large quantity of heat is generated from the heaters. Accordingly, if the conventional thermal inkjet printhead is employed in the array printhead, ink ejection characteristics thereof may degrade.

SUMMARY OF THE INVENTION

The present general inventive concept provides a thermal inkjet printhead to enhance an ink ejecting ability thereof by preventing and/or dissipating heat accumulation around a heater thereof.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet printhead, including a substrate, an insulation layer formed on the substrate, a heater formed on the insulation layer, a conductor formed on the heater to supply a current to the heater, a chamber layer stacked on the insulation layer having the heater and the conductor therebetween, and having an ink chamber formed therein to be filled with ink to be ejected, a nozzle layer stacked on the chamber layer and having a nozzle through which the ink in the ink chamber is ejected, and a plurality of thermal plugs formed in a lower portion of the insulation layer to contact the insulation layer and the substrate and to dissipate heat generated by the heater toward the substrate. The plurality of thermal plugs may include tungsten or silver.

The inkjet printhead may further include a metal layer formed on a top surface of the plurality of thermal plugs. The metal layer may include at least one metal selected from the group consisting of aluminum, aluminum alloy, gold, and silver.

The substrate may be a silicon substrate. The insulation layer may include silicon oxide.

The inkjet printhead may further include a passivation layer formed on surfaces of the heater and the conductor. The passivation layer may include silicon oxide or silicon nitride.

The inkjet printhead may further include an anti-cavitation layer formed on the passivation layer which forms the bottom of the ink chamber. The anti-cavitation layer may include Tantalum.

The foregoing and/or other aspects and utilities of the present general inventive concept may also be achieved by providing a thermal printhead, including a substrate, a chamber layer disposed on the substrate and including an ink chamber to contain ink, a nozzle layer disposed on the chamber layer and including a nozzle to eject the ink, a heating unit to heat the ink and to eject the ink through the nozzle by forming bubbles therein, an insulating layer disposed between the substrate and the heating unit to provide insulation between the substrate and the heating unit, and at least one thermal plug contacting the insulating layer and the substrate to dissipate residual heat generated by the heating unit to the substrate.

The at least one thermal plug may extend in a direction perpendicular to the insulating layer. The at least one thermal plug may extend in a direction parallel to an ink ejecting direction. The at least one thermal plug may have a height that is substantially-equal to one half of a width of the insulating layer. The at least one thermal plug may have a height that is less than one half of a width of the insulating layer. The at least one thermal plug may have a height that is greater than one half of a width of the insulating layer.

The at least one thermal plug may include a plurality of thermal plugs. Each of the plurality of thermal plugs may have an identical shape. At least one plug of the plurality of thermal plugs may have a shape that is different from at least one other plug of the plurality of thermal plugs. Each of the plurality of thermal plugs may have an identical height. At least one plug of the plurality of thermal plugs may have a height that is different from at least one other plug of the plurality of thermal plugs. The plurality of thermal plugs may be disposed at substantially-regular intervals along at least a portion of the insulating layer. The plurality of thermal plugs may be disposed at a position corresponding to a position of the heating unit.

The printhead may further include at least one metal layer contacting the insulating layer and the at least one thermal plug to further dissipate the residual heat generated by the heating unit. The at least one metal layer may be a continuous layer. The at least one metal layer may include a first portion extending in a first direction, and a second portion extending in a second direction having an angle with the first direction. The at least one metal layer may contact a portion of the at least one thermal plug facing the nozzle. The at least one metal layer may contact a second portion of the at least one thermal plug substantially-perpendicular to the first portion. A length of the at least one metal layer may substantially-correspond to a length of the insulating layer. A width of the at least one metal layer is smaller than a height of the at least one thermal plug. The width of the at least one metal layer is less than a width of the insulating layer.

The at least one metal layer may extend in a direction substantially-parallel to the substrate. The at least one metal layer may have a width corresponding to a size of the heating unit. The at least one metal layer may extend in a direction substantially-perpendicular to the at least one thermal plug. The at least one metal layer may include at least one conductive metal. The at least one thermal plug may include the at least one conductive metal. The printhead may further include a conducting layer to supply a current to the heating unit. The conducting layer may include the at least one metal.

The foregoing and/or other aspects and utilities of the present general inventive concept may also be achieved by providing an inkjet print head, including a substrate, a ink chamber region disposed on the substrate to contain ink therein, a nozzle layer disposed on the ink chamber region to eject the ink therefrom, a heating layer disposed below the ink chamber region to heat the ink in the ink chamber region, an insulating layer disposed between the substrate and the heating layer to provide insulation between the substrate and the heating unit, and a heat dissipation layer formed within the insulation layer and extending therethrough to a heat sink region to dissipate heat from the heating layer and the insulation layer.

The heat sink region may be the substrate. The heat dissipation layer may include a metal layer extending along a length of the insulating layer, and at least one projection extending from the metal layer through the insulating layer to the heat sink region. The heat dissipation layer may include a plurality of intermittent projections extending from within the insulating layer to the heat sink region. The plurality of intermittent projections may be disposed at regular intervals within the insulating layer.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
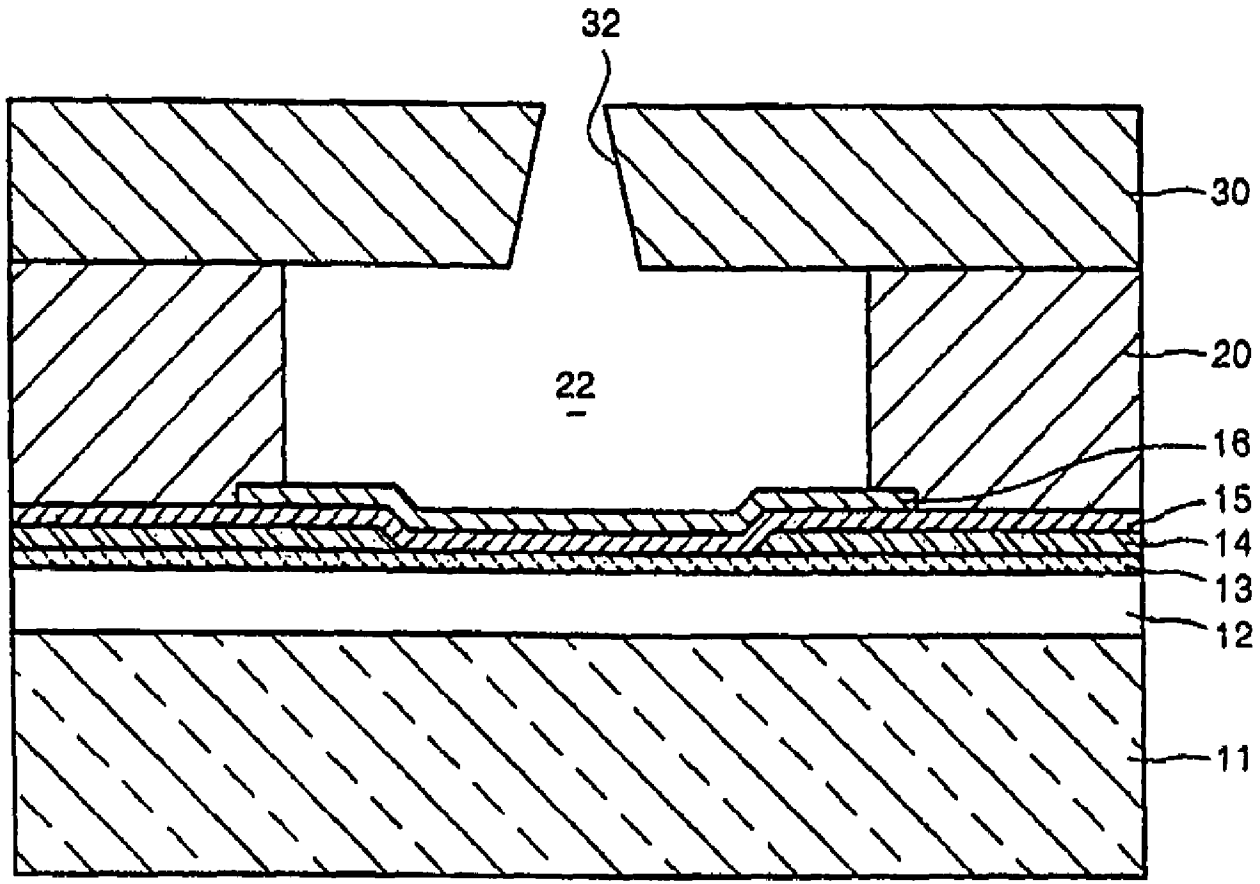
FIG. 1 (PRIOR ART)
FIG. 1 is a schematic cross-sectional view illustrating a conventional thermal inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
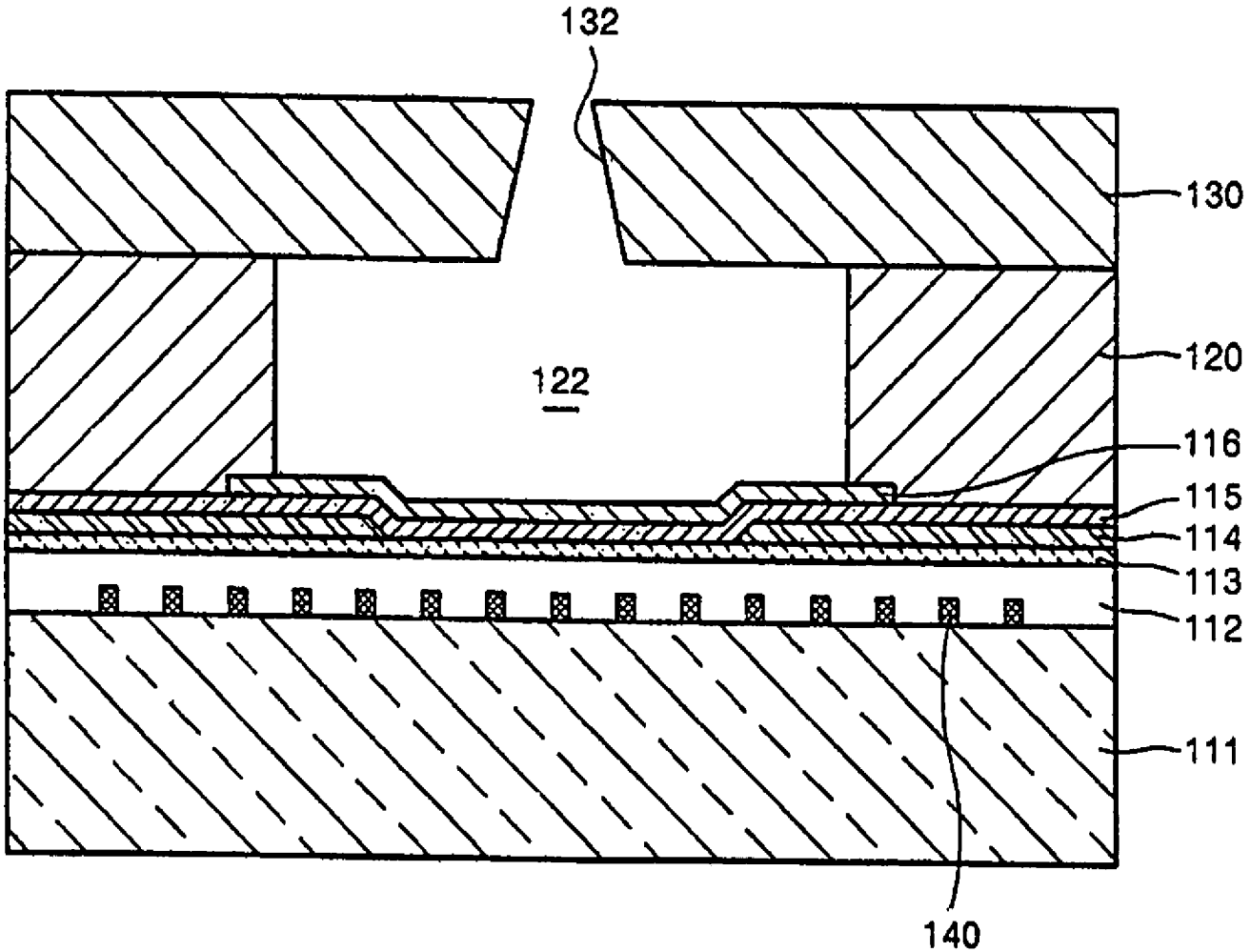
FIG. 2 is a schematic cross-sectional view illustrating a thermal inkjet printhead, according to an embodiment of the present general inventive concept.

FIG. 2 is a schematic cross-sectional view illustrating a thermal inkjet printhead, according to an embodiment of the present general inventive concept. Referring to FIG. 2, an inkjet printhead according to this embodiment includes a substrate 111 on which a plurality of materials layers are formed, a chamber layer 120 stacked on the substrate 111, and a nozzle layer 130 stacked on the chamber layer 120. An ink chamber 122 to be filled with ink to be ejected is formed in the chamber layer 120. A nozzle 132 to eject ink filled in the ink chamber 122 is formed through the nozzle layer 130 on an upper portion of the ink chamber 122. Although the nozzle 132 is illustrated on the upper portion of the ink chamber 122 in FIG. 2, the present general inventive concept is not so limited.

The substrate 111 may be a silicon substrate, but the present general inventive concept is not limited to the substrate 111 being a silicon substrate. An insulation layer 112 having a predetermined thickness is formed on an upper side of the substrate 111 to provide heat and electronic insulation between the substrate 111 and a heater 113, which will be described later. The insulation layer 112 may include silicon oxide, but the present general inventive concept is not limited to the insulation layer 112 including silicon oxide. The heater 113 to heat the ink filled in the ink chamber 122 to generate bubbles is formed on the insulation layer 112. The heater 113 may include a heating resistor made of, for example, a tantalum-aluminum alloy, tantalum nitride, titanium nitride, or tungsten silicide. A conductor 114 to supply a current to the heater 113 is formed on the heater 113. The conductor 114 may include at least one metal having excellent electric conductivity, such as a metal selected from the group consisting of aluminum (Al), an aluminum alloy, gold (Au), and silver (Ag).

A passivation layer 115 to protect the heater 113 and the conductor 114 may be formed on the surfaces of the heater 113 and the conductor 114. The passivation layer 115 prevents the heater 113 and the conductor 114 from oxidizing or directly contacting the ink, and may be formed of silicon oxide or silicon nitride. An anti-cavitation layer 116 may be formed on the passivation layer 115 and forms a bottom of the ink chamber 122. The anti-cavitation layer 116 protects the heater 113 from a cavitation pressure induced by bubble extinction, and may primarily include tantalum (Ta).

A plurality of thermal plugs 140 may be formed in a lower portion of the insulation layer 112 to contact the insulation layer 112 and the substrate 111. The thermal plugs 140 dissipate residual heat from the heater 113 toward the substrate 111. The term "residual heat" refers to heat generated by the heater 113 that does not contribute to the formation of the bubbles in the ink. The residual heat (which does not contribute to the bubble formation by the heater 113) may be accumulated in the insulation layer 112 near the heater 113. Thus, the heat accumulation in the insulation layer 112 can be prevented and/or dissipated by the thermal plugs 140. The thermal plugs 140 may include a high thermal conductive material, such as tungsten (W), silver (Ag), and the like.

The thermal plugs 140 may have a substantially-rectangular shape, as illustrated in FIG. 2. However, the present general inventive concept is not so limited. For example, the thermal plugs 140 may have other shapes suitable to prevent and/or dissipate heat accumulation in the insulation layer 112. In addition, each of the thermal plugs 140 may have the same shape, as illustrated in FIG. 2, one or more of the thermal plugs 140 may have a different shape from others of the thermal plugs 140, or all of the thermal plugs 140 may have different shapes with respect to each other.

The thermal plugs 140 may have a height corresponding to approximately one half of a width of the insulation layer 112, as illustrated in FIG. 2. However, the present general inventive concept is not so limited. For example, the height of the thermal plugs 140 may be less than approximately one half of the width of the insulation layer 112. Alternatively, the height of the thermal plugs 140 may be greater than approximately one half of the width of the insulation layer 112, such as approximately the width of the insulation layer 112. Moreover, although each of the thermal plugs 140 illustrated in FIG. 2 has substantially the same height, the present general inventive concept is not so limited. For example, one or more of the thermal plugs 140 may have a different height from others of the thermal plugs 140, or all of the thermal plugs 140 may have different heights with respect to each other.

The thermal plugs 140 may be disposed at regular intervals along an entire length of the insulation layer 112, as illustrated in FIG. 2. However, the present general inventive concept is not so limited. For example, the thermal plugs 140 may be arranged at irregular intervals along the entire length of the insulation layer 112, or along only a portion of the length of the insulation layer 112. Alternatively, the thermal plugs 140 may be arranged at regular intervals along only a portion of the length of the insulation layer 112, such as only on a left portion thereof, a right portion thereof, a middle portion thereof, or two such portions thereof. Moreover, the thermal plugs 140 may be disposed with respect to a position of the heater 113. For example, if the heater 113 is positioned only on a portion of the insulation layer 112 (in contrast to FIG. 2, where the heater 113 is positioned along an entire length of the insulation layer 112), the thermal plugs 140 may be disposed at a corresponding position.

In the inkjet printhead of the present embodiment, when the current flows through the heater 113 via the conductor 114, the heater 113 generates the heat, and thus the ink in the ink chamber 122 is heated. Accordingly, the bubbles are generated by a portion of the heat and expand in the ink chamber 122. Due to the expansion force of the bubbles, the ink in the ink chamber 122 is ejected from the nozzle 132. The residual heat does not contribute to the bubble formation and often accumulates in the insulation layer 112 near the heater 113. However, the residual heat is rapidly dissipated through the thermal plugs 140, having a high thermal conductivity, toward the substrate 111. Thus, the inkjet printhead according to the present embodiment can prevent and/or dissipate heat accumulation in the insulation layer 112 near the heater 113 after ink ejection, thereby enhancing ink ejection characteristics, such as ink ejection frequency and ink ejection velocity.

Figure 3:
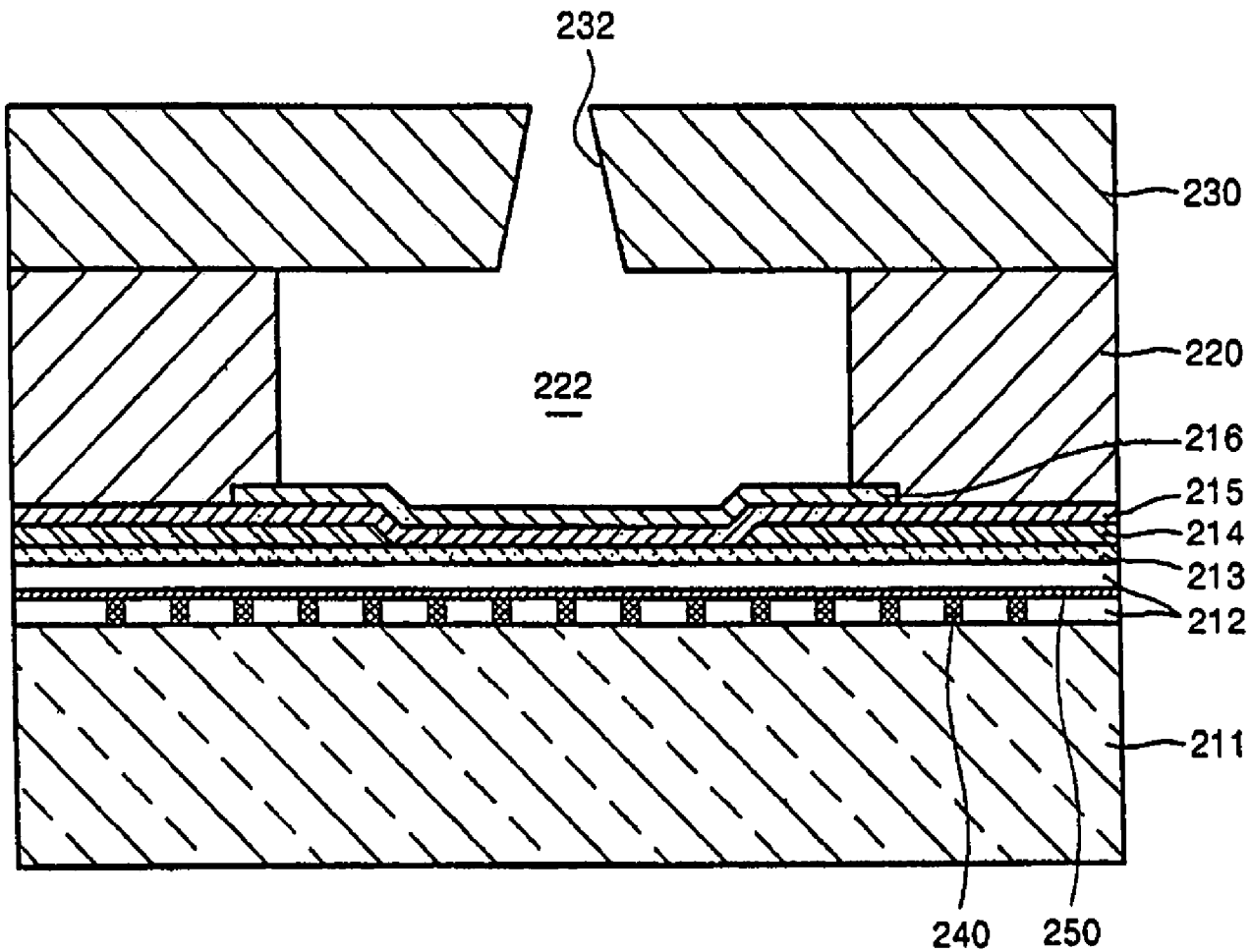
FIG. 3 is a schematic cross-sectional view illustrating a thermal inkjet printhead, according to another embodiment of the present general inventive concept.

FIG. 3 is a schematic cross-sectional view illustrating a thermal inkjet printhead, according to another embodiment of the present general inventive concept. Hereinafter, differences between the present embodiment and the previous embodiment illustrated in FIG. 2 will be mainly described.

Referring to FIG. 3, an inkjet printhead according to the present embodiment includes a substrate 211 on which a plurality of materials layers are formed, a chamber layer 220 stacked on the substrate 111 and having an ink chamber 222 formed therein, and a nozzle layer 230 stacked on the chamber layer 220 and including a nozzle 232.

The substrate 211 may be a silicon substrate, but the present general inventive concept is not limited to the substrate being a silicon substrate. An insulation layer 212 having a predetermined thickness is formed on an upper side of the substrate 211 to provide heat and electronic insulation between the substrate 211 and a heater 213, which will be described later. The insulation layer 212 may include silicon oxide, but the present general inventive concept is not limited to the insulation layer 212 including silicon oxide. A heater 213 is formed on the insulation layer 212, and a conductor 214 is formed on the heater 213. A passivation layer 215, which may include silicon oxide or silicon nitride) to protect the heater 213 and the conductor 214, may be formed on surfaces of the heater 213 and the conductor 214. An anti-cavitation layer 216, which may include tantalum (Ta), may be formed on the passivation layer 215 to form a bottom of the ink chamber 222.

A plurality of thermal plugs 240 may be formed in a lower portion of the insulation layer 212 to contact the insulation layer 212 and the substrate 211. A metal layer 250 may be formed on upper sides of the thermal plugs 240. The metal layer 250 and the thermal plugs 240 dissipate residual heat from the heater 213 toward the substrate 211. The residual heat does not contribute to the bubble formation (i.e., the bubbles formed due to the heat generated by the heater 213) and can accumulate in the insulation layer 212 near the heater 213. However, due to the thermal plugs 240 and the metal layer 250, heat accumulation in the insulation layer 212 is prevented and/or discharged. The thermal plugs 240 may include a high thermal conductive material, such as tungsten (W), silver (Ag), and the like. The metal layer 250 may include the same material as the conductor 214, for example, at least one metal selected from the group consisting of aluminum (Al), aluminum alloy, gold (Au), and silver (Ag).

The thermal plugs 240 may have a substantially-rectangular shape, as illustrated in FIG. 3. However, the present general inventive concept is not so limited. For example, the thermal plugs 240 may have other shapes suitable to prevent and/or dissipate heat accumulation in the insulation layer 212. In addition, each of the thermal plugs 240 may have the same shape, as illustrated in FIG. 3, one or more of the thermal plugs 240 may have a different shape from others of the thermal plugs 240, or all of the thermal plugs 240 may have different shapes with respect to each other.

The thermal plugs 240 may be disposed at regular intervals along an entire length of the insulation layer 212, as illustrated in FIG. 3. However, the present general inventive concept is not so limited. For example, the thermal plugs 240 may be arranged at irregular intervals along the entire length of the insulation layer 212, or along only a portion of the length of the insulation layer 212. Alternatively, the thermal plugs 240 may be arranged at regular intervals along only a portion of the length of the insulation layer 212, such as only on a left portion thereof, a right portion thereof, a middle portion thereof, or two such portions thereof. Moreover, the thermal plugs 240 may be disposed with respect to a position of the heater 213. For example, if the heater 213 is positioned only on a portion of the insulation layer 212 (in contrast to FIG. 3, where the heater 213 is positioned along an entire length of the insulation layer 212), the thermal plugs 240 may be disposed at a corresponding position.

The thermal plugs 240 may have a height corresponding to approximately one half of a width of the insulation layer 212, as illustrated in FIG. 3. However, the present general inventive concept is not so limited. For example, the height of the thermal plugs 240 may be less than approximately one half of the width of the insulation layer 212. Alternatively, the height of the thermal plugs 240 may be greater than approximately one half of the width of the insulation layer 212. Moreover, although each of the thermal plugs 240 illustrated in FIG. 3 has substantially the same height, the present general inventive concept is not so limited. For example, one or more of the thermal plugs 240 may have a different height with respect to others of the thermal plugs 240, or all of the thermal plugs 240 may have different heights with respect to each other.

The metal layer 250 may be a continuous layer and a substantially flat layer, as illustrated in FIG. 3. However, the present general inventive concept is not so limited. For example, the metal layer 250 may be a broken layer having one or more portions that are discontinuous with other portions thereof. Moreover, the metal layer may have portions that extend in a particular direction, and other portions that extend in another direction having an angle with the particular direction.

As discussed above, the metal layer 250 may contact upper sides of the thermal plugs 240, as illustrated in FIG. 3. However, the present general inventive concept is not so limited. For example, the metal layer 250 may contact at least one other side of the thermal plugs 240 in addition to, or instead of, the upper sides thereof. Furthermore, the metal layer 250 may contact identical sides of the thermal plugs 240, as illustrated in FIG. 3, where the metal layer 250 contacts the upper sides of each of the thermal plugs 240. Alternatively, the metal layer 250 may contact different sides of the thermal plugs 240, such as an upper side of one thermal plug 240 and a right side of anther thermal plug 240.

The metal layer 250 may have a length corresponding to a length of the insulation layer 212. However, the present general inventive concept is not so limited. For example, the metal layer 250 may have a length that is shorter than a length of the insulation layer. Furthermore, a width of the metal layer 250 may vary. For example, the width of the metal layer 250 may be less than half of a width of the insulation layer 212, as illustrated in FIG. 3. Alternatively, the width of the metal layer 250 may be greater than half of the width of the insulation layer 212. In addition, the width of the metal layer 250 may vary with respect to a width of one or more other layers of the printhead, such as a width of the heater 213 or a width of the conductor 214.

In the inkjet printhead of the present embodiment, the residual heat generated by the heater 213 and accumulated in the insulation layer 212 is dissipated through the metal layer 250 and the thermal plug 240 toward the substrate 211, thereby preventing the heat accumulation in the insulation layer 212. In addition, the heat accumulated in the insulation layer 212 may be directly dissipated through the thermal plug 240 toward the substrate 211.

As described above, an inkjet printhead according to various embodiments of the present general inventive concept may include a plurality of thermal plugs, which include an excellent thermal conductive material, formed in a lower portion of an insulation layer formed on a substrate to contact the insulation layer and the substrate, thereby effectively dissipating residual heat accumulation in the insulation layer after ink ejection. Accordingly, the inkjet printhead can prevent and/or dissipate residual heat accumulation in the insulation layer, thereby enhancing ink ejection characteristics, such as ink ejection frequency and ink ejection velocity.

The general inventive concept may, however, be embodied in many different forms and should not be construed as being limited to the embodiments set forth herein. For example, it will also be understood that when a layer is referred to as being "on" another layer or a substrate, the layer can be directly on the other layer or the substrate, or the layer can be indirectly on the other layer or the substrate, such as through intervening layers.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead, comprising:

a substrate;

an insulation layer formed on the substrate;

a heater formed on the insulation layer;

a conductor formed on the heater to supply a current to the heater;

a chamber layer stacked on the insulation layer having the heater and the conductor therebetween, and having an ink chamber formed therein to be filled with ink to be ejected;

a nozzle layer stacked on the chamber layer and having a nozzle through which the ink in the ink chamber is ejected; and a plurality of thermal plugs formed in a lower portion of the insulation layer to contact the insulation layer and the substrate and to dissipate heat generated by the heater toward the substrate.

2. The inkjet printhead of claim 1, wherein the plurality of thermal plugs includes tungsten or silver.

3. The inkjet printhead of claim 1, further comprising:

a metal layer formed on a top surface of the plurality of thermal plugs.

4. The inkjet printhead of claim 3, wherein the metal layer includes at least one metal selected from the group consisting of aluminum, aluminum alloy, gold, and silver.

5. The inkjet printhead of claim 1, wherein the substrate is a silicon substrate.

6. The inkjet printhead of claim 1, wherein the insulation layer includes silicon oxide.

7. The inkjet printhead of claim 1, further comprising:

a passivation layer formed on surfaces of the heater and the conductor.

8. The inkjet printhead of claim 7, wherein the passivation layer includes silicon oxide or silicon nitride.

9. The inkjet printhead of claim 7, further comprising:

an anti-cavitation layer formed on the passivation layer to form a bottom of the ink chamber.

10. The inkjet printhead of claim 9, wherein the anti-cavitation layer includes Tantalum.

11. A thermal printhead, comprising:

a substrate;

a chamber layer disposed on the substrate and including an ink chamber to contain ink;

a nozzle layer disposed on the chamber layer and including a nozzle to eject the ink;

a heating unit to heat the ink and to eject the ink through the nozzles by forming bubbles therein;

an insulating layer disposed between the substrate and the heating unit to provide insulation between the substrate and the heating unit; and at least one thermal plug contacting the insulating layer and the substrate to dissipate residual heat generated by the heating unit to the substrate.

12. The printhead of claim 11, wherein the at least one thermal plug extends in a direction perpendicular to the insulating layer.

13. The printhead of claim 11, further comprising:

at least one metal layer contacting the insulating layer and the at least one thermal plug to further dissipate the residual heat generated by the heating unit.

14. The printhead of claim 13, wherein the at least one metal layer is a continuous layer.

15. The printhead of claim 13, wherein the at least one metal layer comprises:

a first portion extending in a first direction; and a second portion extending in a second direction having an angle with the first direction.

16. The printhead of claim 13, wherein the at least one metal layer contacts a portion of the at least one thermal plug facing the nozzle.

17. The printhead of claim 13, wherein the at least one metal layer extends in a direction substantially-parallel to the substrate.

18. The printhead of claim 13, wherein the at least one metal layer extends in a direction substantially-perpendicular to the at least one thermal plug.

19. An inkjet print head, comprising:

a substrate;

a ink chamber region disposed on the substrate to contain ink therein, a nozzle layer disposed on the ink chamber region to eject the ink therefrom;

a heating layer disposed below the ink chamber region to heat the ink in the ink chamber region;

an insulating layer disposed between the substrate and the heating layer to provide insulation between the substrate and the heating unit; and a heat dissipation layer formed within the insulation layer and extending therethrough to a heat sink region to dissipate heat from the heating layer and the insulation layer.

20. The inkjet print head of claim 19, wherein the heat sink region is the substrate.

21. The inkjet print head of claim 19, wherein the heat dissipation layer comprises:

a metal layer extending along a length of the insulating layer; and at least one projection extending from the metal layer through the insulating layer to the heat sink region.

22. The inkjet print head of claim 21, wherein the heat sink region is the substrate.

23. The inkjet print head of claim 19, wherein the heat dissipation layer comprises:

a plurality of intermittent projections extending from within the insulating layer to the heat sink region.

24. The inkjet print head of claim 23, wherein the heat sink region is the substrate.

* * * * *

UNITED STATES PATENT AND TRADEMARK OFFICE

CERTIFICATE OF CORRECTION

PATENT NO. : 7,585,053 B2
APPLICATION NO. : 11/501683
DATED : September 8, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 511 days.

Signed and Sealed this

Fourteenth Day of September, 2010

David J. Kappos

David J. Kappos
*Director of the United States Patent and Trademark Office*